United States Patent [19]

Kato

[11] 4,098,163

[45] Jul. 4, 1978

[54] STRING WINDING DEVICE FOR STRING INSTRUMENTS

[75] Inventor: Kazuma Kato, Gifu, Japan

[73] Assignee: Nikko Seiki Company Limited, Japan

[21] Appl. No.: 768,059

[22] Filed: Feb. 14, 1977

[51] Int. Cl.[2] ..... G10D 3/14

[52] U.S. Cl. ..... 84/306

[58] Field of Search ..... 84/297, 304–306

[56] References Cited

U.S. PATENT DOCUMENTS 3,240,098 3/1966 Hepler ..... 84/306

*Primary Examiner*—John Gonzales

*Attorney, Agent, or Firm*—George B. Oujevolk

[57] ABSTRACT

A string winding device for string instruments comprises a casing to be attached to the top end portion of a string instrument, which has in the interior thereof a container chamber extending in the longitudinal direction and a container chamber extending in the lateral direction, a worm wheel rotatably arranged in the container chamber of the casing extending in the longitudinal direction, a winding shaft extended from the worm wheel outwardly of the casing to wind the end of a string of the string instrument, a worm rotatably disposed in the container chamber of the casing extending in the lateral direction so that the worm is engaged with the worm wheel, an adjustment shaft extended from the worm outwardly of the casing to rotate the winding shaft so as to adjust the quantity of the string wound, a substantially cylindrical bearing member screwed and fixed to the side portion of the casing so that said bearing member can advance and retreat and the worm is gripped and supported between the inner end portion of said bearing member and the inside of the casing to prevent the worm from moving in the axial direction, and an operation knob disposed on the end portion of the adjustment shaft in the state separated from said bearing member.

7 Claims, 7 Drawing Figures

STRING WINDING DEVICE FOR STRING INSTRUMENTS

FIELD OF THE INVENTION

The present invention relates to a string winding device for string instruments. More particularly, the invention relates to a string winding device to be attached to the top end portion of a string instrument such as a guitar to wind the end of a string and adjust the tension on the string.

OBJECTS OF THE INVENTION

It is a primary object of the present invention to provide a string winding device for string instruments in which the play of a worm in a casing is minutely adjusted to prevent shaking of an adjustment shaft in the axial direction and an operation knob attached to the end of the adjustment shaft is turned to rotate a winding shaft thereby to adjust the tension on a string lightly and precisely.

Another object of the present invention is to provide a string winding device for string instruments in which a worm at the end portion of an adjustment shaft can easily be processed by gear cutting and the worm can be arranged stably in a container chamber of a casing.

Other objects and advantages of the present invention will be apparent to those skilled in the art upon reference to the following detailed description and appended claims and on practicing the present invention.

DETAILED DESCRIPTION OF THE PREFERRED EMBODIMENTS

The structure of the string winding device for string instruments according to the present invention will now be described by reference to embodiments shown in the accompanying drawings.

Figure 1:
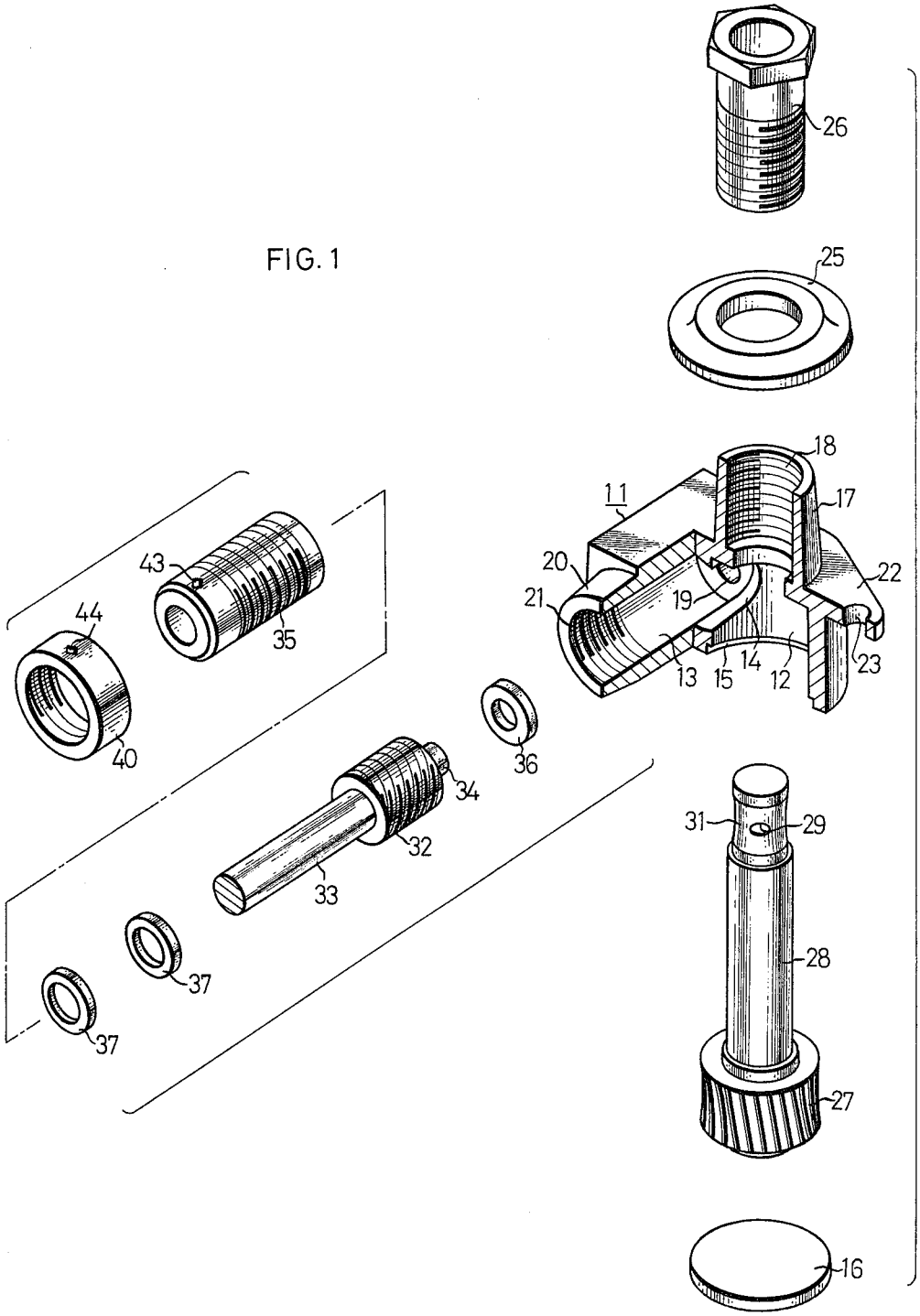
FIG. 1 is a perspective view illustrating in the disassembled state one embodiment of the string winding device for string instruments according to the present invention, in which a casing is shown in the partially cut-out state.

Referring now to FIG. 1, a casing 11 includes in the interior thereof a container chamber 12 extending in the longitudinal direction and a container chamber 13 extending in the lateral direction, and both the container chambers 12 and 13 are communicated with each other through a connecting hole 14. A step portion 15 is formed on an opening at the lower end of the container chamber 12 extending in the longitudinal direction, and a cover 16 is attached to this step portion 15 to close the lower face of the container chamber 12. A cylindrical attachment portion 17 is formed and projected on the top face of the casing 11 so that the lower end of this attachment portion 17 is communicated with the container chamber 12 extending in the longitudinal direction. A female screw 18 is formed on the inner circumferential face of the attachment portion 17. At one end of the container chamber 13 extending in the lateral direction, a supporting concave portion 19 is formed on the inner side face of the casing 11, and a cylindrical supporting portion 20 is formed and projected on the outer side face of the casing 11 so that the other end of the container chamber 13 extending in the lateral direction is opened outwardly of the casing 11. A female screw 21 is formed on the inner circumferential face of the supporting portion 20.

Figure 2:
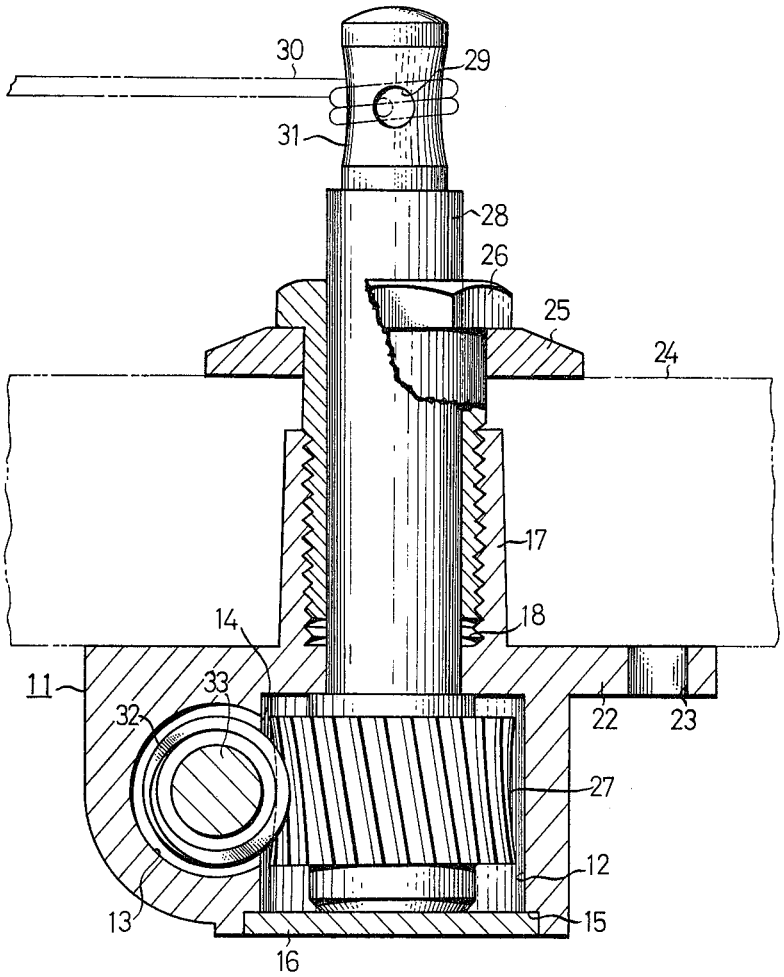
FIG. 2 is an enlarged view showing the longitudinal section of the string winding device, which illustrates the state of attachment of the string winding device to a string instrument.

An attachment seat 22 is formed and projected on the top end of one side of the casing 11 and an attachment hole 23 is formed on the attachment seat 22. When an attachment screw (not shown) is screwed into a head 24 of a string instrument such as a guitar, the casing 11 can be attached to the lower face of the head 24 as shown in FIG. 2. In this attachment state, a cylindrical bolt 26 is screwed into the female screw 18 in the supporting portion 17 on the top face of the casing 11 from the top face of the head 24 through a washer 25, whereby the casing 11 can be fixed to the head 24 of the string instrument in the stable state.

A worm wheel 27 is rotatably arranged in the container chamber 12 extending in the longitudinal direction so that the worm wheel 27 is gripped and supported between the inner face of the top wall of the casing 11 and the cover 16. A winding shaft 28 formed and projected on the top face of the worm wheel 27 pierces the cylindrical bolt 26 and extends upwardly of the head 24 of the string instrument, as shown in FIG. 2. The end of a string 30 is hung on a hanging hole 29 formed on the top end of the winding shaft 28, and the string 30 is wound on a winding portion 31 of a reduced diameter formed in the top end portion of the winding shaft 28.

A worm 32 is rotatably arranged in the container chamber 13 of the casing 11 extending in the lateral direction so that the worm 32 is engaged with the above-mentioned worm wheel 27, and an adjustment shaft 33 formed and projected on one side face of the worm 32 is extended outwardly of the side portion of the casing 11 through the interior of the supporting portion 20. The worm 32 is processed by gear cutting along the entire peripheral face of a large diameter portion formed at a part close to the inner end of the adjustment shaft 33, and a small diameter shaft portion 34 projected from the inner end portion of the worm 32 is fitted and inserted in the supporting concave portion 19 formed on the inner side face of the casing 11, whereby the worm 32 is rotatably supported in the container chamber 13.

A cylindrical bearing member 35 is screwed into the female screw 21 of the supporting portion 20 of the casing 11 so that it can advance and retreat and the adjustment shaft 33 can be supported. One sliding ring 36 is fitted and supported on the shaft portion 34 so that it is located between one end of the worm 32 and the inner side face of the casing 11, and two sliding rings 37 are fitted and supported on the adjustment shaft 33 so that they are located between the other end of the worm 32 and the inner end portion of the bearing member 35. By this arrangement, both the end portions of the worm 32 are prevented from falling in direct contact with the casing 11 or the bearing member 35. Accordingly, even if the entire peripheral face of the large diameter portion formed at a part close to the adjustment shaft 33 is processed by gear cutting as described hereinbefore, the gear cuts appearing on both the end faces of the worm 32 are prevented from falling in direct contact with the inner side face of the casing 11 or the inner end portion of the bearing member 35, and therefore, the adjustment shaft 33 can be lightly rotated.

An operation knob 39 is attached to the outer end portion of the adjustment shaft 33 through an attachment screw 38 in the state separated from the outer end face of the bearing member 35, and by rotating the adjustment shaft 33 by this operation knob 39, the winding shaft 28 is rotated through the worm 32 and the worm wheel 27 to change the quantity of the wound string 30 and adjust the tension on the string 30.

Figure 6:
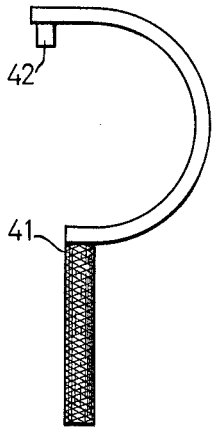
FIG. 6 is a front view showing one embodiment of means for rotating and adjusting a bearing member.
Figure 3:
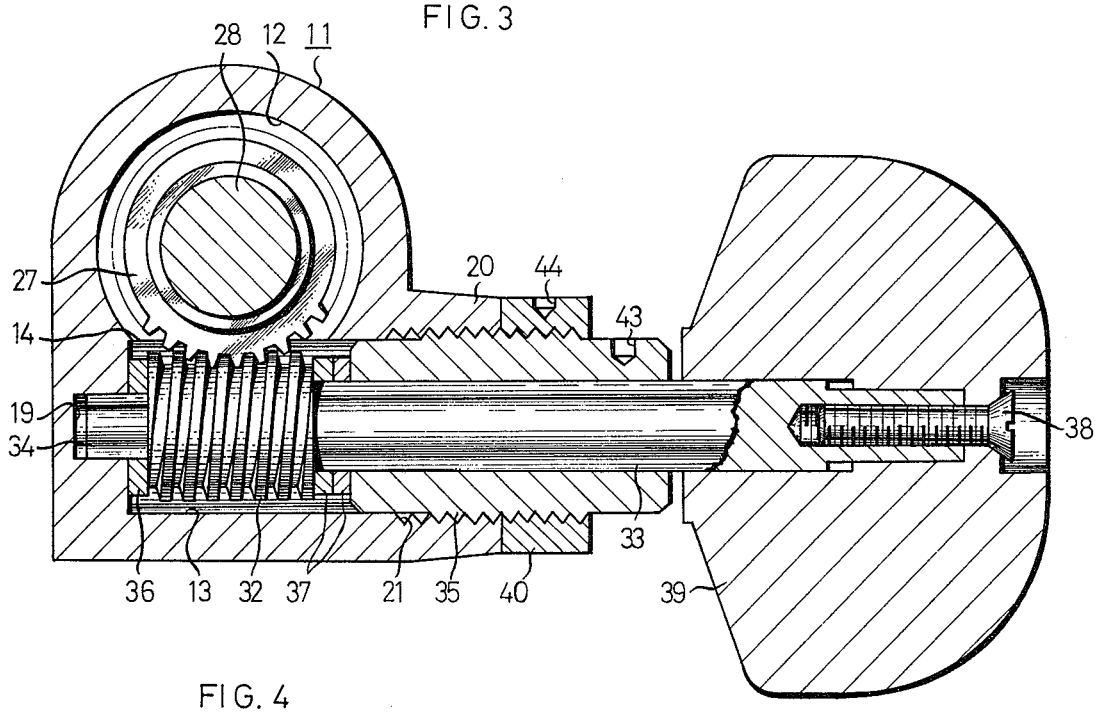
FIG. 3 is a view showing the cross-section of the string winding device.

In the embodiment illustrated in FIGS. 1 to 3, a fixing nut 40 is screwed and fixed to the periphery of the bearing member 35 so that the nut 40 falls in contact with the outer edge of the supporting portion 20 of the casing 11 to fix the bearing member 35 at a predetermined position with respect to the supporting portion 20. In this arrangement, when a tool 41 as shown in FIG. 6 is used, an engaging projection 42 of the tool 41 is hung on an engaging hole 43 formed on the periphery of the bearing member 35 and the bearing member 35 is turned, whereby the worm 32 is gripped and supported between the inner end portion of the bearing member 35 and the inner side face of the casing 11 through the sliding rings 36 and 37. Then, the engaging projection 42 of the tool 41 is hung on an engaging hole 44 formed on the periphery of the fixing nut 40 and the fixing nut 40 is turned, whereby the bearing member 35 is locked and is not allowed to move at all and shaking of the worm 32 or the adjustment shaft 33 in the axial direction can be prevented assuredly.

Figure 7:
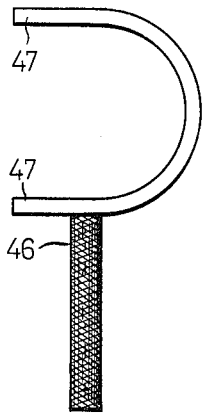
FIG. 7 is a front view showing another embodiment of means for rotating and adjusting a bearing member.
Figure 4:
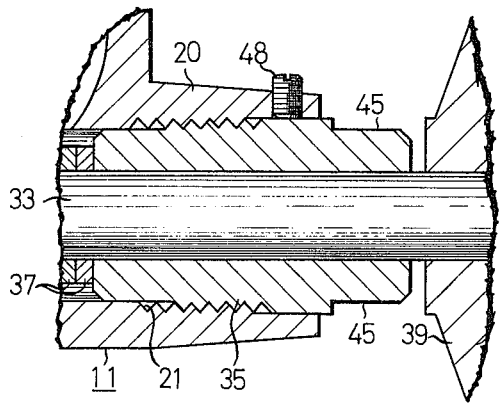
FIG. 4 is a cross-sectional view of a part of the string winding device, which illustrates one embodiment of the structure for fixing a bearing member at a predetermined position.

In an embodiment shown in FIG. 4, a pair of engaging concave portions 45 are formed by notching on the periphery of the outer end portion of the bearing member 35. An engaging piece 47 of a tool 46 as shown in FIG. 7 is engaged with the engaging concave portion 45 to rotate and adjust the bearing member 35. In this embodiment, a fixing screw 48 is screwed and fixed from the periphery of the supporting portion 20 of the casing 11 toward the bearing member 35, so that the bearing member 35 can be locked at a predetermined adjustment position.

Figure 5:
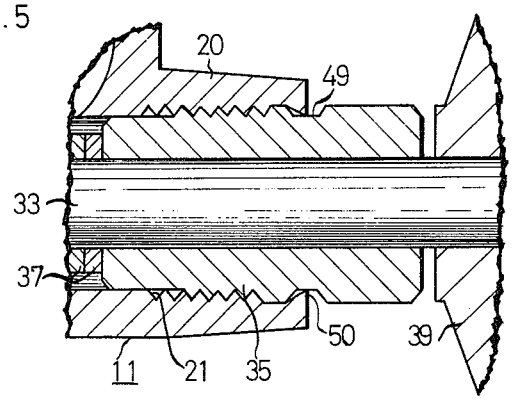
FIG. 5 is a cross-sectional view of a part of the string winding device, which illustrates another embodiment of the structure for fixing a bearing member at a predetermined position.

In an embodiment shown in FIG. 5, a fitting groove 49 is formed on the periphery of the bearing member 35 at a part close to the outer end, and a fitting portion 50 is formed on the peripheral edge of the outer end of the supporting portion 20 of the casing 11 so that the fitting portion 50 is fitted and inserted in the fitting groove 49. By this engagement of the portions 49 and 50, the bearing member 35 can be held at a predetermined adjustment position.

As will be apparent from the foregoing illustration, in the string winding device for string instruments according to the present invention, the degree of screwing of the bearing member to the casing is adjusted so that the worm is gripped and supported between the inner end portion of the bearing member and the inside of the casing to prevent shaking of the adjustment shaft in the axial direction. In this arrangement, if the operation knob attached to the end portion of the adjustment shaft in the state spaced from the bearing member is turned, the winding shaft is turned through the worm and the worm wheel and the tension on the string can be adjusted lightly and precisely. Further, in the string winding device of the present invention, the worm is molded by forming gear cuts on the entire periphery of the large diameter portion formed on the adjustment shaft at a part close to the inner end thereof and sliding rings are disposed to fall in contact with both the end faces of the worm. Accordingly, gear cutting processing of the worm can easily be performed and the worm can be disposed in the container chamber of the casing in the very stable state.

Having disclosed the present invention in terms of preferred embodiments, it will be apparent to those skilled in the art that it may be variously practised within the spirit and scope of the claims set forth below.

What I claim is:

1. A string winding device for string instruments, which comprises a casing to be attached to the top end portion of a string instrument, which has in the interior thereof a container chamber extending in the longitudinal direction and a container chamber extending in the lateral direction, a worm wheel rotatably arranged in the container chamber of the casing extending in the longitudinal direction, a winding shaft extended from the worm wheel outwardly of the casing to wind the end of a string of the string instrument, a worm rotatably disposed in the container chamber of the casing extending in the lateral direction so that the worm is engaged with the worm wheel, a substantially cylindrical bearing member screwed and fixed to the side portion of the casing so that said bearing member can advance and retreat and the worm is gripped and supported between the inner end portion of said bearing member and the inside of the casing to prevent the worm from moving in the axial direction, an adjustment shaft extended from the worm outwardly of the casing while piercing through the bearing member so that it rotates the winding shaft so as to adjust the quantity of the string wound, and an operation knob disposed on the end portion of the adjustment shaft in the state separated from said bearing member.

2. A string winding device for string instruments as set forth in claim 1 wherein said worm is molded by forming gear cuts on the entire periphery of a large diameter portion formed at a part close to the inner end of the adjustment shaft and the worm is rotatably supported on the inside of the casing at a small diameter shaft portion projected on the inner end portion of the worm.

3. A string winding device for string instruments as set forth in claim 1 which further comprises sliding rings disposed between one end of the worm and the inside of the casing and between the other end of the worm and the inner end of the bearing member, respectively.

4. A string winding device for string instruments as set forth in claim 1 wherein a cylindrical supporting portion is projected on the side portion of said casing and said bearing member is screwed into said supporting portion.

5. A string winding device for string instruments as set forth in claim 1 which further comprises means for setting and fixing said bearing member at a predetermined position.

6. A string winding device for string instruments as set forth in claim 5 wherein said setting and fixing means is a fixing nut screwed into the peripheral portion of the bearing member so that if falls in contact with the side portion of the casing.

7. A string winding device for string instruments as set forth in claim 5 wherein said setting and fixing means is a fixing screw screwed from a part of the casing toward the bearing member.

* * * * *